United States Patent [19]

Strait

[11] 4,023,459

[45] May 17, 1977

[54] BRIDGE FOR A STRINGED INSTRUMENT

[76] Inventor: Carl Hope Strait, P.O. Box 34, Andover, N.J. 07821

[22] Filed: July 30, 1975

[21] Appl. No.: 600,492

[52] U.S. Cl. ..... 84/309

[51] Int. Cl.[2] ..... G10D 3/04

[58] Field of Search ..... 84/309, 308, 307, 298

[56] References Cited

UNITED STATES PATENTS

| | | | |
|---|---|---|---|
| 361,659 | 4/1887 | White | 84/309 |
| 1,459,057 | 6/1923 | Jones | 84/309 |
| 1,783,117 | 11/1930 | Gosparlin | 84/309 |
| 2,446,267 | 8/1948 | Dahn | 84/309 |
| 3,120,145 | 2/1964 | Weinreich | 84/307 |

FOREIGN PATENTS OR APPLICATIONS

| | | | |
|---|---|---|---|
| 736,946 | 9/1932 | France | 84/309 |
| 1,058,110 | 11/1953 | France | 84/309 |
| 338,458 | 6/1921 | Germany | 84/309 |

*Primary Examiner*—Stephen J. Tomsky
*Attorney, Agent, or Firm*—H. Hume Mathews

[57] ABSTRACT

A bridge for a stringed instrument, preferably a violin, is disclosed for the purpose of enhancing the volume and tone quality of the instrument. The bridge is made from wood and has an upper generally oval body portion which is supported by the lower inverted V-shaped leg section. The body portion includes four slits through its width, associated with the strings as described in detail in the specification. The leg portion includes two slits aligned to form another inverted V-shape conforming to the shape of the leg portion. The leg portion may also have holes drilled into it for the purpose of removing material to reduce the overall weight of the bridge. Several preferred contours are disclosed for the body portion, one of which may be selected for use with different stringed instruments.

4 Claims, 8 Drawing Figures

BRIDGE FOR A STRINGED INSTRUMENT

BACKGROUND OF THE INVENTION

1. Field of the Invention

This invention is a bridge for supporting the strings of a stringed instrument. While the description in this application is written in terms of a violin bridge, the basic features of the structure are equally adaptable to bridges for use on other stringed instruments which are played with a bow.

2. Brief Description of the Prior Art

A bridge on a violin, or other instrument, is typically thought of as holding and supporting the strings; however, its more important function is to precisely transmit sound vibrations from the strings to the body of the instrument. The transmission and resonant qualities of the bridge are extremely important to the overall tone quality and volume of the instrument, and a poor bridge can ruin the sound produced by a good violin. Likewise, many young people have learned to play using stock quality instruments which could produce a reasonably good sound if equipped with a quality bridge, such as the one disclosed here.

One difficulty the bridge development in the prior art is that it must be done by trial and error. Quite simply, one must make each bridge by hand and then use it on the instrument to determine how the tone is affected by a specific structure. A number of different types of bridges are known in the prior art, but none are known which are similar to Applicant's bridge described herein.

SUMMARY OF THE INVENTION

A bridge is disclosed for supporting the strings of a stringed instrument, preferably a violin. The bridge includes a body portion which is generally oval in shape, having two broad faces and a peripheral edge, the upper portion of said edge having string receiving notches and forming a ridge which is flattened with respect to a pure oval shape. The bridge further has a leg portion in the shape of an inverted "V" with two legs extending downwardly and outwardly from an apex, said leg portion extending into, merging with, and supporting said body portion. In the preferred embodiment, a number of slits are provided in both the body and leg portions to enhance the quality and volume of sound transmission from the strings to the body of the instrument. Several alternative contours are also disclosed for the body portion, at least one of which will provide superior performance on a stringed instrument.

DETAILED DESCRIPTION OF A PREFERRED EMBODIMENT

In order to produce a bridge of the highest quality, it should be hand made and then custom fitted to the instrument on which it is used. No two violins are alike and no two pieces of wood from which a bridge is to be made are alike, so it is impossible to exactly describe the structure of this invention. Therefore, the following description should be interpreted as establishing goals for the structural form of a bridge, rather than the precise dimensions and shape of the actual finished product. Of necessity, all dimensions given are approximate, and they are offered for the purpose of describing the invention as fully as possible without limiting the scope of the invention.

Figure 1:
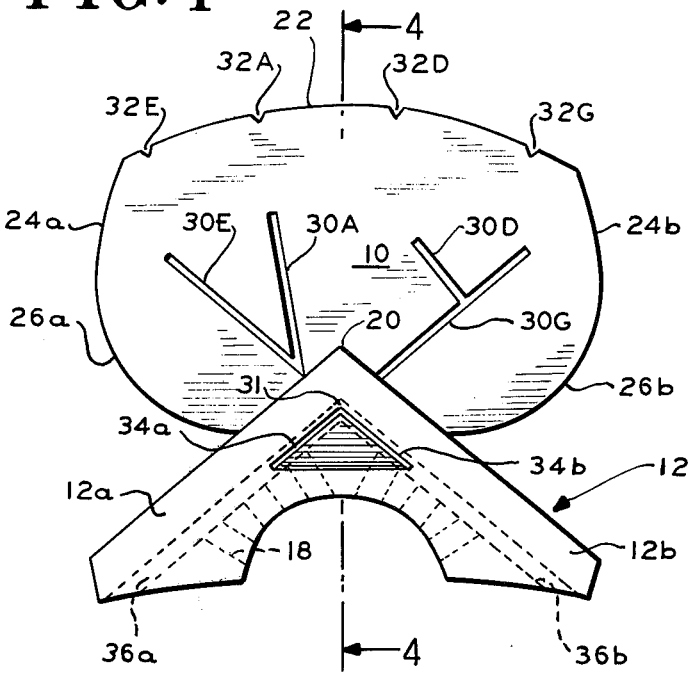
FIG. 1 is a front elevation of a preferred embodiment of this invention showing a broad face of the bridge.
Figure 2:
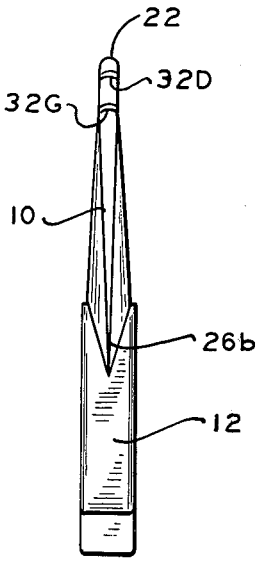
FIG. 2 is a side elevation of the bridge shown in FIG. 1.
Figure 5:
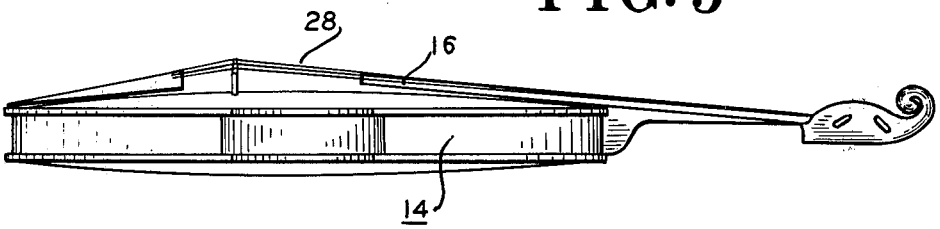
FIG. 5 is a side view of a violin with a bridge according to this invention installed.
Figure 3:
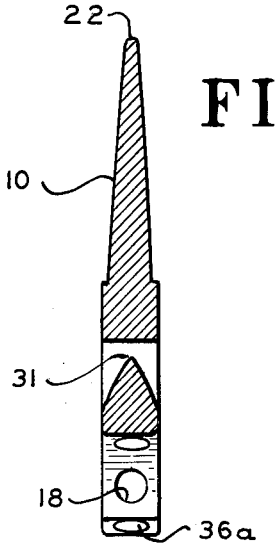
FIG. 3 is a section taken along the line 3—3 shown in FIG. 1.
Figure 4:
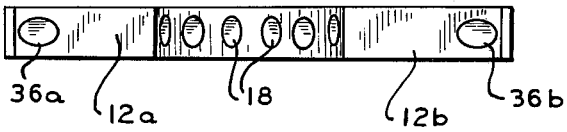
FIG. 4 is a bottom view of the bridge shown in FIG. 1.

While this invention may be adapted to any stringed instrument which is played with a bow, many of its dimensions are dictated by the structure of the instrument with which it is used. Although the initial design of each bridge is the same, no two instruments are precisely the same and each bridge should be specially fitted to the instrument to support the strings in a specific manner and to produce the most superior sound. Therefore, in the following description it will be assumed that the bridge is used with a violin. Further, in order that this specification and the annexed claims may be understood the bridge will be described as though viewed perpendicularly from its broad face with the G-string notch appearing on the right and the E-string notch appearing on the left, as is shown in FIG. 1. From this point of view certain features of the bridge will be described as "right" or "left", or "upper" or "lower", as will be understood.

The bridge of this invention is best made from a single piece of wood of uniform grain and texture. It should be carved by hand from wood cut on the quarter (as is known in the prior art) with dimensions of about 2 in. square by ¼ in. thick. Before hand carving, the wood should be allowed to dry thoroughly but naturally.

As shown in FIG. 1, a bridge is viewed from one of its broad sides so that the G-string notch 32G appears on the right and the E-string notch 32E appears on the left. The bridge has a body portion 10 and left and right legs **12*a* and 12*b*. The body 10 is roughly oval in shape, presenting two broad faces and a peripheral edge, the upper ridge of said edge being slightly flattened or truncated, with the long dimension of the body 10 disposed approximately horizontally as it is mounted on the violin 14. Legs 12 generally form an inverted V-shape with the apex 20 of the V merging into the lower portion of the oval shaped body 10. The angle formed at the apex 20 by the sides of legs 12*a* and 12*b* is preferably between 90° and 105°**.

The bridge may be made from any material or combination of materials including wood, plastic and metal, but wood is preferred and maple, hickory, locust and ebony empirically seem to produce the best tone and amplification. Preferably the bridge is hand carved from a single piece of material.

When made for use with a violin the bridge may be about 1 11/16 in. high; however, the precise height will be determined by the violin itself. When the bridge is installed on the violin the legs **12*a* and 12*b* are individually cut or shaved so that each of the four strings is supported at an equal distance, preferably about ⅛ in. above the end of finger board 16, which is nearest to the bridge 10. The width of the bridge is about 1 13/16 in. but again the precise dimension is dictated by the specific violin. Preferably, the strings should be supported with a horizontal spacing betwee them of about 7/16 in., and the body 10 of the bridge should extend about another ⅛ in. beyond that on each side; however, the total width of the body should be selected to produce the most superior sound. Legs 12***a* and 12*b* may be spaced apart to extend outwardly to a width approximately equal to that of body 10, but this will vary somewhat depending upon the degree of shaving of the legs 12*a* and 12*b* when the bridge is installed on a violin as previously described. Preferably, the overall weight of the bridge is near the total weight of the portion of the four strings which are strung on the violin, or about 2.6 grams. The material in the center of the lower portion of legs 12*a* and 12*b* may be removed to the extent necessary to reduce the weight of the bridge, provided that the legs 12*a* and 12*b* are sufficiently strong to support the pressure of the strings 28 which may be about 26 pounds total in the case of a violin. Additional material may be removed if necessary by drilling several holes 18 into the bottom of the leg portion 12 without excess weakening of the legs. Removal of material between the legs, together with the inverted V shape of the leg portion presents an arch-like structure to support the body 10 while producing excellent vibrational transmission characteristics.

The thickness of the bridge may vary to meet the weight and strength preference stated above but generally the thickness ranges between 3/16 and 1/16 in. at different points on the bridge. The legs 12*a* and 12*b* are thickest at the base and may taper slightly to the apex 20. The body 10 is thickness near its center, but still thinner than the apex 20. The thickness of the body 10 tapers from the center to about 1/16 in. at the upper ridge line 22, and the body 10 may taper to or near a fine edge around the left and right sides 24*a* and 24*b* and the right wings 26*a* and 26*b* along the lower portion of the body 10. It is impossible to give accurate dimensions for thickness of the bridge at different points because it should be hand made and each one will be different. Different craftsmen may find that straight or concave or convex tapering of the thickness may be preferably depending upon the characteristics of the wood from which the bridge is made.

The body 10 of the bridge is provided with two sets of intersecting slits, generally designated 30, extending therethrough. Each slit 30 is best described in reference to one of the strings of the violin and, therefore, in the drawings the slits are designated as 30E, 30A, 30D and 30G to correspond with the E, A, D and G strings. It is also useful for this description to define a point 31 on the bridge which is located about 3/16 in. directly below the apex 20 and when the bridge is placed on a violin this point will be approximately mid-way between the surface of the violin (i.e. the lowest extent of the legs) and the highest point along the ridge 22 of the bridge. This point 31 may be thought of as the heart of the bridge and many of the features of the bridge may be described with respect to it.

Figure 7:
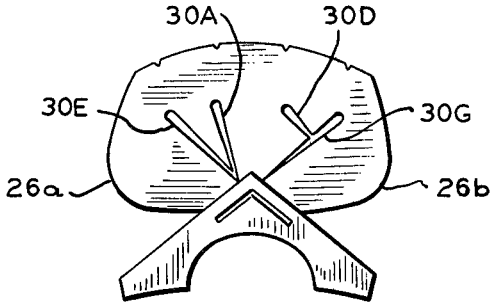

Slit 30E extends along the line which is parallel to the side of right leg 12*b* in alignment with the point 31. Slit 30E preferably extends from the point on this line where the body 10 merges with the side of left leg 12*a*, to the point on said line vertically below the E-string notch 32E. Slit 30E should be about ⅝ in. long. Slit 30G should be about the same length as slit 30E and extend along the line which is parallel to the side of left leg 12*a* in alignment with the point 31. Slit 30G preferably extends from the point on this line where the body 10 merges with the side of right leg 12*b*, to the point on said line vertically below the G-string notch 32G. Slit 30D is preferably approximately parallel to slit 30E and to the side of right leg 12*b*. Slit 30D should extend on this line from the point which is the same distance vertically below D-string notch 32D as the point of terminus of slit 30G is below the G-string notch 32G, to the point where slit 30D intersects slit 30G. The distance from notch 32D to the end of the slit 30D should be about ⅛ in. Slit 30A should extend from the point again the same distance vertically below notch 32A to the point where slit 32E terminates at or near left leg 12*a*, where slits 30E and 30A intersect. All of the slits 30 are shown as being straight in the Figures numbered 1 through 6 and in FIG. 8. However, in some cases tapered slits may produce better sound transmission as shown in FIG. 7. Preferably the distance between the upper terminus of each slit 30 and the corresponding notch 32 located directly above it is the same distance, preferably being about ⅛ in. If slits 30G and 30E were extended along the same lines into the leg portion of this bridge, they would meet at point 31.

Left and right legs 12*a* and 12*b* are also preferably provided with left and right slits 34*a* and 34*b* beginning at point 31 and extending about 11/32 in. down the leg, preferably parallel to the respective side of the leg 12*a* or 12*b* so as to form an inverted V with its apex at point 31. Slits 34*a* and 34*b* intersect at point 31. Legs 12*a* and 12*b* may also be provided with holes 36*a* and 36*b* which may be drilled into the bottom of each leg near the center thereof, parallel to the sides of legs 12*a* and 12*b* and to a sufficient depth to intersect interiorly of the leg at point 31. All slits 30 and 34 should be about 1/32 in. in width. Holes 36 are preferably about 5/64 in. in diameter, but this dimension may be varied as necessary to achieve the bridge weight and strength objectives specified above. It has also been found that the application of heat to produce a light charring or burning of the interior surfaces in the holes 36 will improve performance of the bridge in some cases. The thickness in the area between slits 34*a* and 34*b* may also be tapered toward the apex formed by the slits 34 at point 31. If necessary to further reduce the weight of the bridge, additional material may be removed from between legs 12*a* and 12*b*, preferably by drilling several holes 18 as shown in the drawings.

Figure 6:
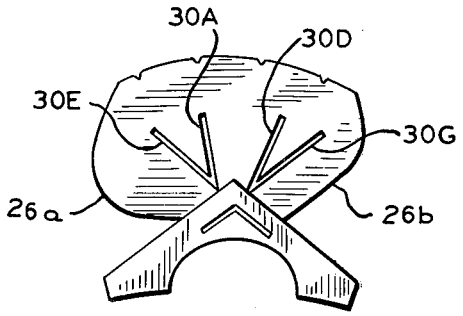
FIGS. 6, 7 and 8 illustrate, by front elevations, the alternative contours and variations in the slits of the preferred embodiments of this invention.
Figure 8:
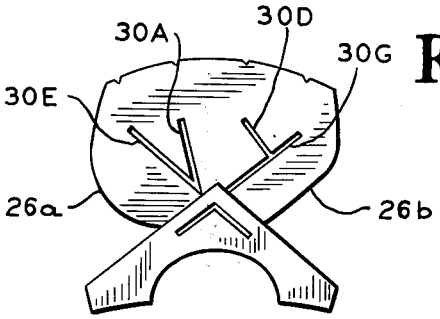

Alternative embodiments of this bridge may take a number of forms. Slit 30D may extend from the point described beneath the D-string notch 32D to intersect slit 30G at the point where slit 30G terminates at right leg 12*b*, as shown in FIG. 6. For any configuration of the bridge the peripheral contour of the edge may be varied as shown in FIGS. 6–8. These Figures show a number of preferred basic contours which may perform more or less well on a specific instrument. In FIG. 1 the wing portions 26*a* and 26*b* of body 10 are rounded and approximately symmetrical, roughly forming segments of an oval with the remaining contour of body 10. In the form shown in FIGS. 6 and 8, right wing 26*b* on the G-string side is cut to a flat edge which is approximately parallel to the side of left leg 12*a*. In the form shown in FIG. 7 both wings 26*a* and 26*b* are approximately symmetrical, but larger than in the form of FIG. 1. Also, each wing 26 may be cut to form a straight edge approximately parallel to the side of the leg 12 on the opposite side of the bridge. The wings in embodiments shown in FIGS. 1 and 7 may or may not be symmetrical so as to produce the best results. Although the precise mechanism is not known, at least one of the contours described will usually perform better than the others on a specific violin. At the time of installation, one of these contours should be chosen empirically to produce the best volume and quality of tone from each of the E, A, D and G strings.

The bridge described may also be used with other stringed instruments with the described dimensions altered both in scale and to account for the individual characteristics and dimensions of the instrument.

It should be understood that the above description is for purposes of illustration of the preferred embodiments of this invention and that numerous variations may be made without departing from the scope of the invention.

I claim:

1. A bridge for use with a stringed instrument comprising:

a. a solid upper body portion, being generally oval in shape forming two opposed broad faces and a peripheral edge, the upper portion of the edge defining a ridge which is flattened with respect to a pure oval shape and having notches in said ridge for receiving the strings of the instrument;

b. a lower leg portion generally forming an inverted "V" with respect to the body portion, with an apex and two diverging legs having sides extending downwardly and outwardly from said apex in the plane of the body portion, the upper part of said leg portion extending into, merging with and being attached to said upper body portion, so that when the bridge is mounted on a stringed instrument, the legs will rest on the body of the instrument and support the body portion of the bridge, which will support the strings; said leg portion and body portion in combination presenting a right side and a left side when viewed from a point perpendicular to the plane of the body and leg portions;

c. first, second, third and fourth string receiving notches, numbered from left to right, in the upper portion of the ridge and first, second, third and fourth slits through the body portion, described with respect to said notches as follows:

d. the first slit extending on a line parallel to the side of the right leg, in alignment with the point vertically below said apex and midway between the highest point on the ridge and the lowest extent of the legs, said slit extending from the point where the left leg merges with the body portion, to the point vertically below the first notch;

e. the second slit intersecting with and extending from the end of the first slit at the side of the left leg, to the point vertically below the second notch which is the same distance below the second notch as the point of terminus of the first slit is below the first notch;

f. the fourth slit extending on a line parallel to the side of the left leg in alignment with the point vertically below said apex and midway between the highest point on the ridge and the lowest extent of the legs, said slit extending from the point where the right leg merges with the body portion, to the point vertically below the fourth notch;

g. the third slit extending on a line parallel to the side of the right leg, from a point which is the same distance vertically below the third notch as the point of terminus of the first slit is below the first notch, to the point where the third slit intersects the fourth slit.

2. The bridge of claim 1 as used on a violin wherein the first, second, third and fourth notches receive the E, A, D and G strings, respectively, of the violin.

3. The bridge of claim 1 further comprising right and left slits in the leg portion intersecting at the point vertically below said apex which is midway between the upper portion of the ridge and the lowest extent of the leg portion, said right and left slits each extending downwardly and outwardly parallel to the right and left legs, respectively, to points in said legs slightly below the lowest extent of said body portion.

4. The bridge of claim 3 wherein the section of the leg portion lying between the right and left slits is reduced in thickness to taper upwards towards the intersection of said slits.

* * * * *